US006815649B2

(12) United States Patent
Beer

(10) Patent No.: US 6,815,649 B2
(45) Date of Patent: Nov. 9, 2004

(54) DEVICE AND METHOD FOR INDUCTIVE BILLET HEATING WITH A BILLET-HEATING COIL

(75) Inventor: Stefan Beer, Menden (DE)

(73) Assignee: I.A.S. Induktions-Anlagen + Service GmbH & Co. KG., Iserlohn (DE)

( * ) Notice: Subject to any disclaimer, the term of this patent is extended or adjusted under 35 U.S.C. 154(b) by 38 days.

(21) Appl. No.: 10/201,448

(22) Filed: Jul. 23, 2002

(65) Prior Publication Data

US 2003/0019868 A1 Jan. 30, 2003

(30) Foreign Application Priority Data

Jul. 25, 2001 (DE) ..... 101 35 396
Feb. 15, 2002 (DE) ..... 102 06 269

(51) Int. Cl.[7] ..... H05B 6/08

(52) U.S. Cl. ..... 219/646; 219/656; 219/662; 219/667; 266/129; 148/572

(58) Field of Search ..... 219/646, 645, 219/636, 643, 653, 656, 655, 662, 671, 667; 266/129, 87; 148/572, 567

(56) References Cited

U.S. PATENT DOCUMENTS 4,307,276 A * 12/1981 Kurata et al. ..... 219/650
4,845,332 A * 7/1989 Jancosek et al. ..... 219/645

FOREIGN PATENT DOCUMENTS

| | | |
|---|---|---|
| DE | 30 40 820 A1 | 5/1982 |
| DE | 32 46 273 A1 | 6/1984 |
| JP | 63161219 | 6/1988 |

* cited by examiner

*Primary Examiner*—Philip H. Leung
(74) *Attorney, Agent, or Firm*—Michael J. Striker

(57) ABSTRACT

A device for inductive billet-heating includes a single or multi-layer billet-heating coil (4) for a round billet (5), in which the billet-heating coil (4) is made up of one or more consecutive, galvanically separated zones. The zones are supplied with electrical energy from a three-phase network by means of an electrical switching device and a control unit. The billet-heating coil (4) includes multiple, synchronically regulated zones (Z1, Z2 through Zn) with reference to frequency and phase of inductive field. For a current feed to each zone (Z1 through Zn) of the billet-heating coil (4), a converter (2) with variable frequency and a plurality of modules is provided. The converter includes plurality of power-moderate closed units with DS-network feed and synchronization of phase and frequency of an output voltage.

8 Claims, 4 Drawing Sheets

DEVICE AND METHOD FOR INDUCTIVE BILLET HEATING WITH A BILLET-HEATING COIL

BACKGROUND OF THE INVENTION

The present invention relates to a device for inductively heating a billet with one or multi-layered billet heating coils and a method for inductively heating a billet with one or multi-layer billet heating coils.

Until now, billet heating assemblies of this type have a billet heating coil in single or multi-layered embodiments, a transport device for the heated billets or billet, and an electrical switching device for the temperature regulator. The billet-heating coil in such known devices comprises one or more galvanically separated zones. These are arranged sequentially such that the billet or billet support, upon the heating, is located completely in the zones of the billet-heating coil.

The electrical switching device supplies the Individual zones of the billet-heating coil with electrical energy via switching relays, such as furnace relays or Thyristor control elements. The switching relays, as well as the furnace relays and Thyristor control elements have a limited number of switching actions per unit of time. Thyristor control elements work friction-free, as opposed to the furnace relays.

The electrical energy, commonly supplied from the three-phase main supply network, is converted in the coil into an energy of the magnetic field with a determined output, and thus, through induction, is conveyed into the charge (billet or ingot). The energy of the magnetic field is converted in the billet into heat. The temperature is measured on the surface of the billet.

If the temperature at the measuring position lies under the provided desired temperature, the power of the associated zone is switched on by a temperature regulator. If the surfaces of the billet have reached the desired temperature, the power is switched off. With this two-point control, the existing power for supply is either switched on or completely switched off. In order to reduce the switching actions per unit of time of the switching organs, a temperature hysteresis is necessary with this type of control. The mains restoration takes place with a time difference only then (or in a moment) when the temperature on the surfaces of the billet goes below a provided value.

The temperature hysteresis of the two-point regulation has a large affect on the temperature accuracy of the warming on the billet. The abrupt switching on and off of the power causes network reactions in the form of inrush currents.

An affect of the radial temperature separations on the billet or billet (temperature difference between the core of the billet and their surfaces) is possible because of inertia only in a limited manner through the recovery or compensating time. Upon a turning off of the current, the billet endures during the recovery time either in the coil or externally in a compensating furnace.

The following disadvantages are associated with the above known devices:

- the current-supplying network is not symmetrically loaded;
- the switched-on current operates on the supplying network with a greater power/voltage as a result of the on/off switching;
- the precision of the temperature regulator is impaired by the switching hysteresis. A smaller switching hysteresis for achieving a higher temperature effectiveness causes more switching action of the switching apparatus per unit of time, where the number of switching actions per unit of time of the switching apparatus, however, is limited;
- no possibility exists for performing a thorough, uniform heating of the billet by the integration of the power division in application via frequency changes;
- upon heating, the radial temperature gradients in the billet are always at their largest.

SUMMARY OF THE INVENTION

The present invention addresses the underlying problem of avoiding this inaccuracy and difficulty with the inductive billet heating with the goal of a precise construction of the temperature field in the billet for the most uniform and energy-saving radial and axial division of the temperature in the billet as possible, and therewith, a higher temperature accuracy and a better recurrence of the desired temperature profile in consideration of the permissible temperature gradient in the billet. In addition, the present invention provides the quickest and most efficient heating with a smaller energy consumption without requiring temperature measurement during the heating phase. The temperature should first be controlled after the warming.

This problem is solved with a device according to the present invention, in which the billet-heating coil is made up of multiple synchronically regulated zones relating to frequency and phase of the inductive field. A converter is provided for the current feed to each zone of the billet-heating coil with variable frequency and a modular construction, which is made up of a plurality of closed or self-contained power units with three-phase network feed and synchronization of phase and frequency of the output current.

The inductive billet-heating assembly is constructed with multiple zones, Z1 through Zn. It includes a multiple-zone and multi-layer billet-heating coil in a water-cooled form and a compensation-condenser connected thereto. A temperature measuring device is located in each zone, and indeed, pneumatically operation measuring points or an optical pyrometer T1 through Tn corresponding to the number of the n-zones (FIG. 2).

In addition, a converter having a modular construction is provided. All converter modules M1 through Mn form closed or self-contained power units. The three-phase network feed and synchronization of the phase and frequency of the output current is common for the modules.

The control takes place on an SPS-basis with a process visualization system with which the controller action of the converter module is implemented on the basis of a mathematical algorithm.

Next, the controller action of the converter module will be briefly described:

The power of zones Z1 through Zn of the billet-heating coil is regulated on the basis of the associated measured zone temperatures. For power regulation, the material value (and its temperature dependency), the geometry of the billet, and the energy-consumption ability of the billet (dP/dt) are included. The goal of the regulation is to achieve a specified temperature profile (in the tolerance region) in the shortest heating time, whereby these criteria determined simultaneously the maximal efficiency of the heating.

In order to realize the above goals, the control of the optimal frequency for the operation of the multi-layered inductive billet-heating coil is determined. The limiting value for the temperature dependent temperature gradients in the billet (input) limit the timely development of the measured temperature on the billet surfaces. An answer-back signal via the actual temperature gradients in the billet and the temperature on the surface of the billet allows the temperature field in the billet to be determined.

The method is applied in connection with multi-layer billet-heating coils and a converter.

For inductive billet heating, an inductive billet-heating assembly serves round billets made of copper, aluminum, and their alloys, as well as iron and austenitic materials of larger diameters.

The current feed takes place by means of a converter.

the converter has a modular construction;

the modules are synchronized (frequency and phase of the field);

the frequency is variable;

the output quantities of the converter (voltage, current) are sinus-shaped;

the load or charge of the current network is symmetrical, independent from the number of connected zones of the billet-heating coil; and the noise production in the assembly is reduced by means of a specialized control algorithm of the power electronics.

The billet-heating call is a multi-layer embodiment comprising multiple zones. The individual zones are with respect to the power supply independently supplied with energy, namely, individual via corresponding converter module. The current feed of all zones is synchronized in frequency and phase of the field produced.

The frequency of the feed voltage (of the current) is variable in a wide area and is regulated during the heating of the billet. The regulation of the power of the individual zones of the billet-heating coil rests on a mathematical model, which considers the weight, the material characteristics, the temperature on the surface of the billet, and the timely development of this temperature. In this manner, the following features of the heating are achieved:

a method for quickly and inductively heating the billet is combined with a good, uniform through-heating;

an energy-savings is provided by means of the adjustment of the frequency of the current at the optimal value in dependence on the billet diameter, the alloy of the billet and the temperature, and indeed, under minimizing of the coil waste, as well as optimizing of the division of the energy sources in the billet;

consideration of the thermally limited mechanical voltages in the billet of special alloys with the shortest heating times.

DETAILED DESCRIPTION OF THE PREFERRED EMBODIMENTS

Figure 1:
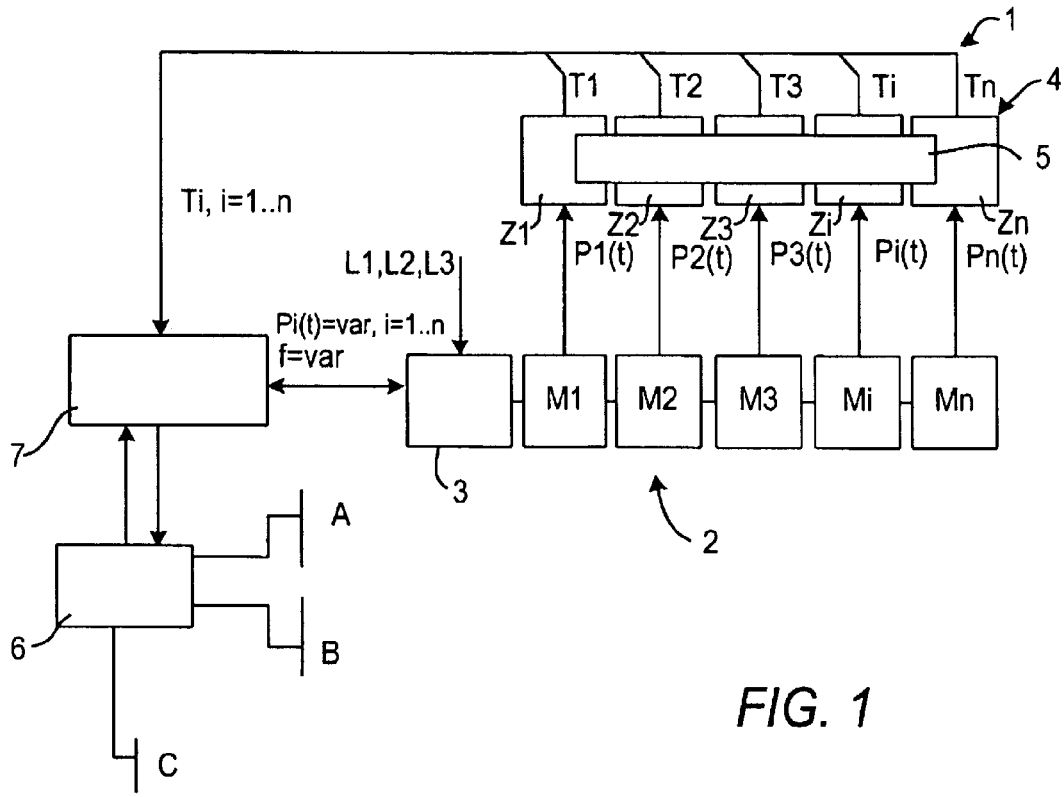
FIG. 1 shows the power portion and the control structure of an inductive billet-heating assembly with a converter feed according to the present invention.

The power part shown in FIG. 1 and the control assembly of an inductive billet-heating assembly 1 comprises a three-phase converter 2 in a modular construction, which is connected to the three-phase network. The converter 2 comprises a feed module 3 with network connections L1, L2, L3 and multiple converter modules M1 through Mn. The feed module 3 includes a power switch and a control unit, which synchronizes the work of individual converter modules M1 through Mn. Each convener module M1 through Mn forms a closed unit, or self-contained unit, comprising a network filter (optional), a converter, an intermediate circuit (smoothing reactor and direct current capacitor battery), an inverted converter (on the basis of a half or complete bridge), and a converter control.

A billet-heating coil 4 is connected to the converter modules M1 through Mn, which comprises multiple, for example, three, four, or more sequentially arranged zones Z1, Z2, Z3, through Zn. Each individual zone Z1 through Zn of the billet-heating coil is connected to an applicable converter module M1 through Mn. The individual converter modules M1 through Mn are so synchronized that the field produced in each zone Z1, Z2, Z3 through Zn is synchronized in phase with the neighboring fields (synchronization of the converter modules). One special feature lies in the control of the individual converter modules, which form separate units and are so synchronized that the produced induction field in each coil zone has no phase displacement to the induction field of the neighboring zones, and indeed, is completely independent from the power of the converter modules.

A temperature control of the assembly with temperature measuring positions on each zone Z1, Z2 through Zn of the billet-heating coil 4 control the individual converter modules or coil zones so that the desired temperature profile, represented by the value T1 through Tn, is available at a determined time point in which the heated billet are available, namely the recall of the billet to the press.

In order to achieve this state, the assembly of the following indicators in the control unit 7 is provided via a regulator 6 in FIG. 1 according to a mathematical model for control:

A—Information about the charging material (physical qualities of the material, geometry of the charging material);

B—Limiting conditions of the heating process, namely, maximal power of the individual zones of the billet-heating coil, temperature tolerances of the temperature field in the billet, limitations of the frequency regions of the converter modules, allowable temperature gradients in the application as well as the efficiency of the converter modules relative to the number of the actuated zones and their power;

C—Target functioning, namely, minimal heating time of the billet, temperature filed in the tolerance area, and minimal energy consumption.

Figure 2:
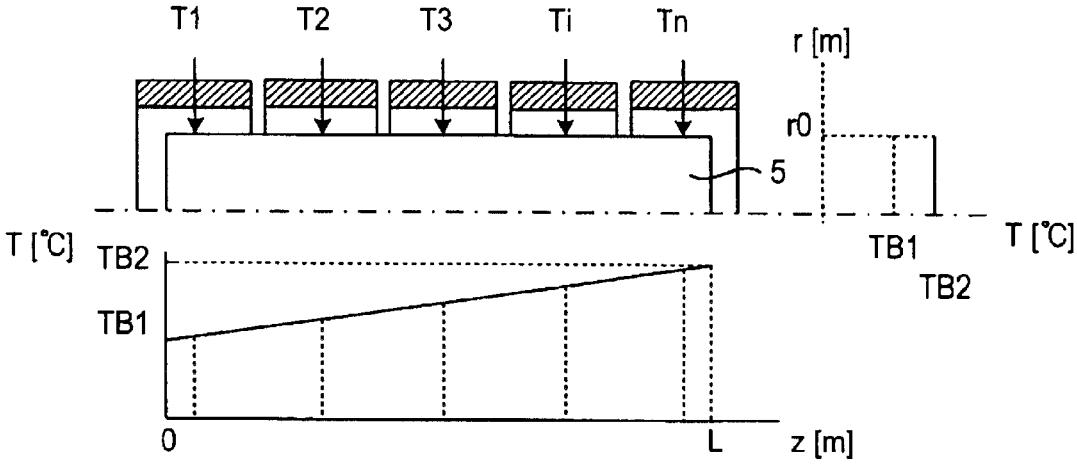
FIG. 2 shows an arrangement of the temperature measuring points in the billet-heating assembly of the present invention with a graphical representation of the targeted temperature profiles.

In FIG. 2, an arrangement of the temperature measuring positions in the billet-heating assembly 1 is shown with a graphical representation of the target temperature profile. Each zone Z1, Z2 through Zn of the billet-heating coil 4, respectively, is associated with a temperature measurement position for determining the temperature value T1, T2 through Tn. In the lower part of the illustration, a uniform temperature development over the length of the billet 5 is shown from the value TB1 at the start of the billet to the value TB2 at the end of the billet.

Figure 3:
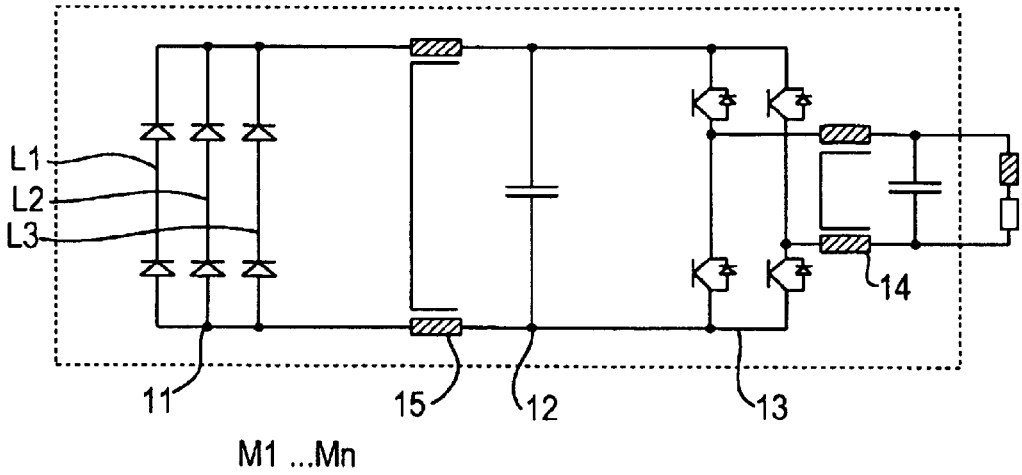
FIG. 3 shows the electrical switching of an individual converter module of FIGS. 1 and 2 and the connection of a partial coil of the billet-heating assembly.

FIG. 3 shows the electrical switch of an individual converter module M1 through Mn from FIGS. 1 and 2, and the connection of a coil part of the billet-heating coil assembly, whereby each converter module has at its disposal its own control, so that here, a redundant system is provided.

A converter module M1 through Mn forms a dosed or self-contained unit and comprises a converter 11, a direct current intermediate circuit 12, and an inverted converter 13. The converter 11 is constructed on the basis of a three-phase full bridge. The electrical energy, which is drawn from the three-phase network with the network connections L1, L2, L3, is therewith converted to energy of the direct current in the DC-intermediate circuit 12. This energy is stored in a direct current capacitor battery. A DC-intermediate circuit choke 15 minimizes the reciprocal effects of the inverted converter 13 and of the converter 11. The inverter converter 13, preferably a transistor full bridge, converts the DC energy into an alternating-current voltage with the extended frequency and voltage (power).

Figure 4:
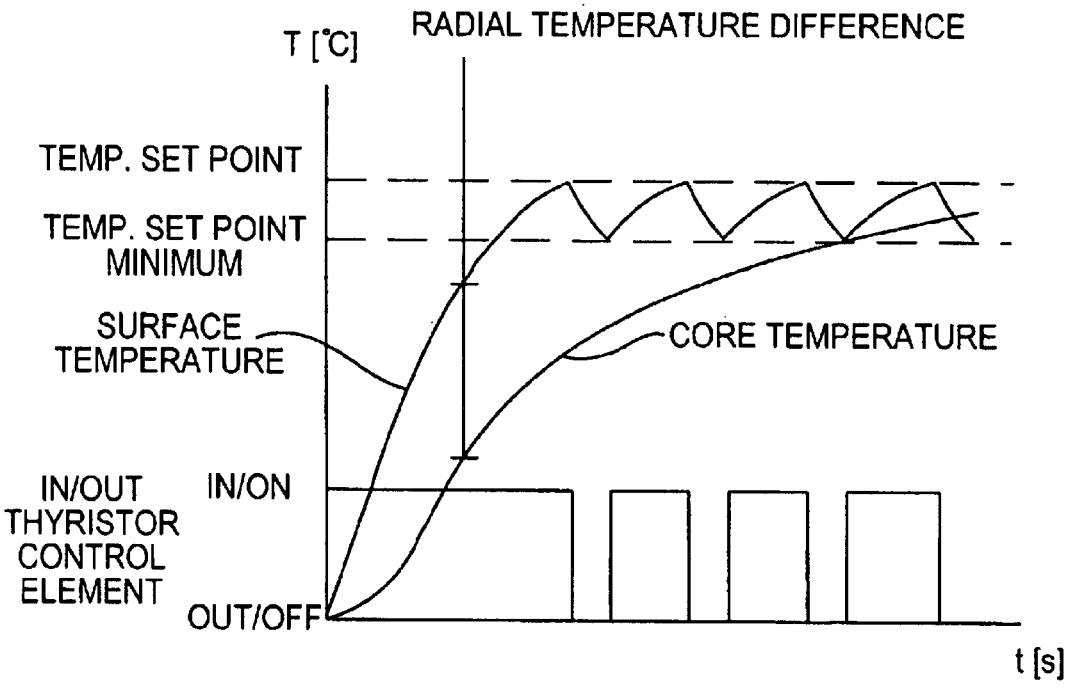
FIG. 4 PRIOR ART
FIG. 4 shows a temperature-time diagram of a known billet-heating assembly with two-point regulation and thyristor control element (IN/OUT with maximal power)

FIG. 4 is a temperature-time diagram of a known billet-heating assembly of the prior art with two-point regulation and a Thyristor plate control element (IN/OUT with maximal power). From the development of the temperature curves on the surface and in the core of the charging material and the resulting radial temperature difference, it can be determined that the two-point regulation, by the continuous on/off switching of the complete power, negatively effects the accuracy of the temperature (temperature hysteresis). The temperature difference between the billet core and its surface, therefore, is difficult to control. This is also the case for the control of the radial temperature gradients in the billet, which, based on the constant power value, is likewise difficult to realize.

Figure 5:
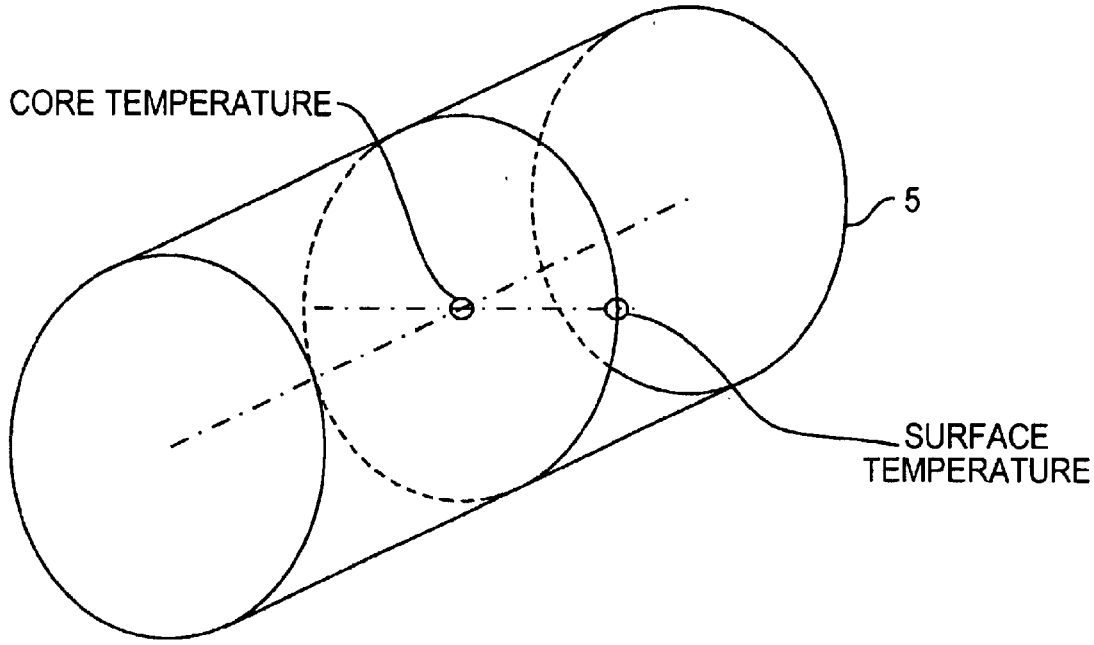
FIG. 5 shows a billet to be heated in a front view with the relevant temperature-measuring regions.
Figure 6:
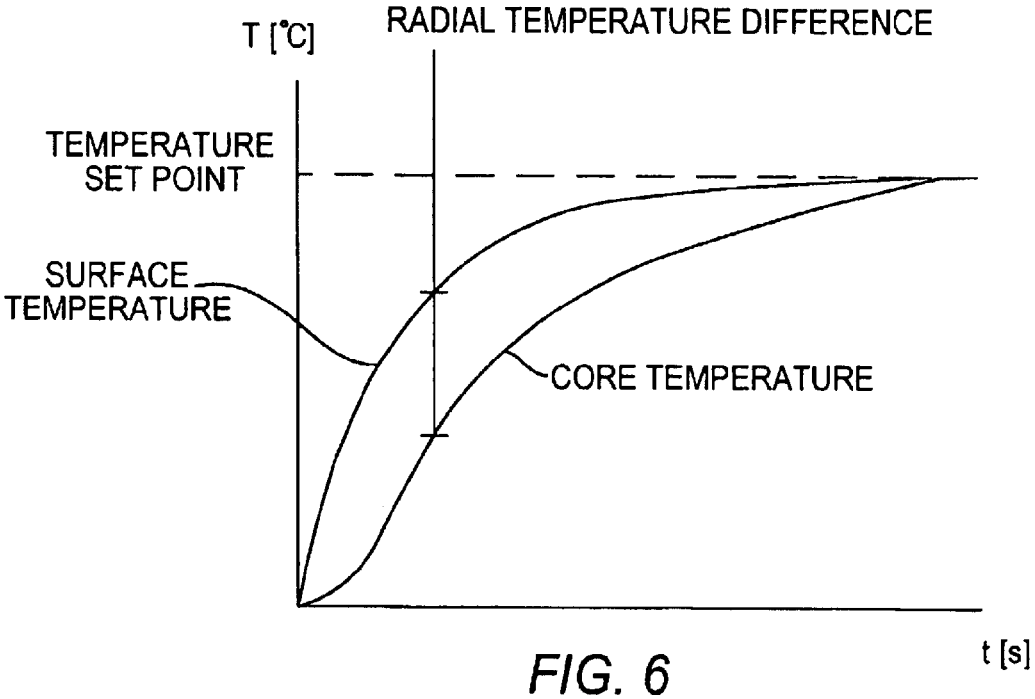
FIG. 6 shows the temperature development upon operation of the billet-heating assembly of the present invention.

FIG. 5 shows a billet to be heated in a front view with the relevant temperature measuring area in the billet core and at the surface of the billet 5.

FIG. 5 shows the temperature development upon operation of the billet-heating assembly of the present invention. By means of the uniform development of the temperature curves on the surface and in the core of the billet and the resulting radial temperature difference, it is evident that here, in a surprising manner, a particularly uniform and energy-conserving radial and axial temperature division in the billet can be achieved, along with a higher temperature accuracy, in total, with a faster and more efficient heating with smaller energy consumption.

Figure 7:
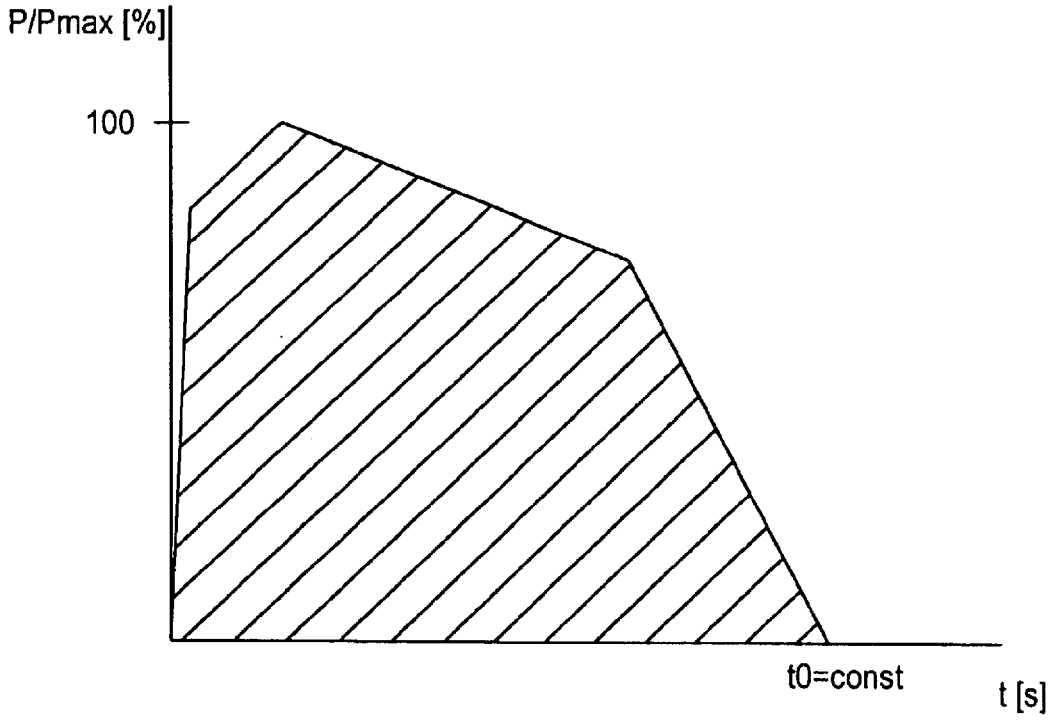
FIG. 7 shows an exemplary power curve upon operation of the assembly of the present invention with stabilized power regulation with desired values of between 0 and 100%, which are continuously controllable.

Through the formation of the power curve, as in FIG. 7, the temperature difference between the billet core and the billet surface can be minimized. The optimization can take into account the further limiting features set forth under point "C" above.

FIG. 7 shows an exemplary power curve upon operation of the inventive system with constant power regulation with desired values from 0 to 100%, which is constantly controllable.

In order to achieve the desired results with the billet-heating assembly of the present invention, the following constructive individual items and their cooperation should be taken into account:

The modular construction of the converter. The converter modules form separate units, which are synchronized;

The billet-heating coil is divided into multiple zones. Each zone is supplied by a converter module. The field produced under each zone is in phase with the neighboring fields (synchronization of the converter module):

The formation of a power-time curve for each converter module makes possible repeatable heating results (taking into account the limiting conditions) without temperature measurement during the heating phase.

It will be understood that each of the elements described above, or two or more together, may also find a useful application in other types of constructions differing from the types described above.

While the invention has been illustrated and described herein as a device and method for inductive billet heating with a billet-heating coil, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A device for inductive billet heating, comprising a single or multi-layer billet-heating coil (4) for round billets (5), wherein the billet-heating coil (4) comprises one or more consecutive, galvanically separated zones, said zones being supplied with electrical energy from a three-phase network by means of an electrical switching device and a control unit, wherein the billet-heating coil (4) comprises multiple, synchronically regulated zones (Z1, Z2 through Zn) with reference to frequency and phase of inductive field, and wherein for a current feed to each zone (Z1 through Zn) of the billet-heating coil (4), a converter (2) is provided, comprising a plurality of converter modules (M1 through Mn) with variable frequency for a current feed to each separate zone (Z1 through Zn) of the billet-heating coil (4), wherein each converter module (M1 through Mn) forms a closed or self-contained power unit with three-phase network feed and synchronization of phase and frequency of the output voltages, and wherein the separate converter modules (M1 through Mn) are synchronized in such a manner that the produced induction field in each coil zone has no phase displacement to induction of the neighboring zones and is completely independent from power of the converter module.

2. The device according to claim 1, wherein an output quantity of current and voltage of the converter (2) is sinus-shaped.

3. The device according to claim 1, wherein the control of the converter modules (M1 through Mn) occurs based on a storage-programmable controller with a process-visualizations system.

4. The device according to claim 1, wherein in each one of the billet-heating coils (4), a temperature measuring device for measuring a temperature of the billet is disposed, wherein said temperature measuring device is connected with a control unit (7) for the converter modules (M2 through Mn).

5. The device according to claim 1, wherein each converter module (M1 through Mn) comprises a converter (11), a direct current intermediate circuit (12), and an inverted converter (13).

6. The device according to claim 5, wherein the converter (11) is a three-phase full bridge and the inverted converter (13) is a transistor full bridge.

7. The device according to claim 5, wherein a DC-intermediate circuit choke (15) for minimizing reciprocal effects of the inverted converter (13) and the converter (11) is provided.

8. The device according to claim 1, wherein said billet is made of a material selected from the group consisting of copper, aluminum, copper or aluminum alloys, iron material or austenitic materials.

* * * * *